US008177338B2

(12) United States Patent
Andrews et al.

(10) Patent No.: US 8,177,338 B2
(45) Date of Patent: May 15, 2012

(54) HIGH FREQUENCY MECHANICALLY ACTUATED INKJET

(75) Inventors: John R. Andrews, Fairport, NY (US); Terrance Lee Stephens, Molalla, OR (US); Gerald A. Domoto, Briarcliff Manor, NY (US); Bradley J. Gerner, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 372 days.

(21) Appl. No.: 12/635,134

(22) Filed: Dec. 10, 2009

(65) Prior Publication Data

US 2011/0141202 A1 Jun. 16, 2011

(51) Int. Cl.
*B41J 2/045* (2006.01)

(52) U.S. Cl. ..... 347/71

(58) Field of Classification Search ..... 347/68–69, 347/70–72; 400/124.14, 124.16; 310/311, 310/324, 327
See application file for complete search history.

(56) References Cited

U.S. PATENT DOCUMENTS

| | | | | |
|---|---|---|---|---|
| 4,308,547 | A | 12/1981 | Lovelady et al. | |
| 4,459,601 | A | 7/1984 | Howkins | |
| 4,697,193 | A | 9/1987 | Howkins | |
| 4,703,330 | A | 10/1987 | Culpepper | |
| 5,063,393 | A | 11/1991 | Clark et al. | |
| 5,689,291 | A | 11/1997 | Tence et al. | |
| 5,736,993 | A | 4/1998 | Regimbal et al. | |
| 5,754,204 | A | 5/1998 | Kitahara | |
| 5,907,338 | A | 5/1999 | Burr et al. | |
| 6,003,971 | A | 12/1999 | Hanks et al. | |
| 6,102,512 | A | 8/2000 | Torir et al. | |
| 6,139,132 | A | 10/2000 | Yasukawa et al. | |
| 6,378,972 | B1 | 4/2002 | Akiyama et al. | |
| 6,422,684 | B1 | 7/2002 | Ladabaum et al. | |
| 6,502,915 | B1 | 1/2003 | Feinn et al. | |
| 6,536,878 | B2 | 3/2003 | Kasperchik et al. | |
| 6,761,436 | B2 | 7/2004 | Tobita et al. | |
| 6,793,311 | B2 | 9/2004 | Baba et al. | |
| 6,805,420 | B2 | 10/2004 | Sumi | |
| 6,886,924 | B2 | 5/2005 | Hasenbein et al. | |
| 7,140,554 | B2 | 11/2006 | Chang | |
| 7,445,314 | B2 * | 11/2008 | Lee et al. | 347/71 |
| 7,467,840 | B2 | 12/2008 | Dijksman et al. | |
| 7,517,056 | B2 | 4/2009 | Fellner et al. | |
| 7,703,895 | B2 * | 4/2010 | Lee et al. | 347/68 |
| 7,744,199 | B2 * | 6/2010 | Yoo et al. | 347/71 |
| 2007/0206079 | A1 | 9/2007 | Brown et al. | |
| 2009/0219313 | A1 | 9/2009 | Suzuki et al. | |
| 2009/0225135 | A1 | 9/2009 | Suzuki | |
| 2009/0225141 | A1 | 9/2009 | Suzuki | |
| 2009/0244128 | A1 | 10/2009 | Ozawa et al. | |
| 2009/0244200 | A1 | 10/2009 | Ozawa | |

* cited by examiner

*Primary Examiner* — Kristal Feggins
(74) *Attorney, Agent, or Firm* — Maginot, Moore & Beck, LLP

(57) ABSTRACT

An inkjet ejector has been developed that enables the ejector to be operated at a frequency greater than 80 kHz. The inkjet ejector includes a body layer in which a pressure chamber is configured with an outlet having a volume that is less than a predetermined volumetric threshold, a flexible diaphragm plate disposed on the pressure chamber to form a wall of the pressure chamber, a piezoelectric transducer having a bottom surface attached to the diaphragm plate, and an inlet layer in which an inlet channel is configured to connect the pressure chamber to a source of liquid ink, a cross-sectional area of the inlet channel at the pressure chamber divided by a length of the inlet channel being greater than a predetermined linear threshold.

16 Claims, 5 Drawing Sheets

HIGH FREQUENCY MECHANICALLY ACTUATED INKJET

TECHNICAL FIELD

This disclosure relates generally to inkjet imaging devices, and, in particular, to inkjets in print heads used in inkjet imaging devices.

BACKGROUND

Drop on demand inkjet technology has been employed in commercial products such as printers, plotters, and facsimile machines. Generally, an inkjet image is formed by the selective activation of inkjets within a print head to eject ink onto an ink receiving member. For example, an ink receiving member rotates opposite a print head assembly as the inkjets in the print head are selectively activated. The ink receiving member may be an intermediate image member, such as an image drum or belt, or a print medium, such as paper. An image formed on an intermediate image member is subsequently transferred to a print medium, such as a sheet of paper, or a three dimensional object, such as an electronic board or a bioassay.

FIGS. 5A and 5B illustrate one example of a single inkjet 10 that is suitable for use in an inkjet array of a print head. The inkjet 10 has a body 22 that is coupled to an ink manifold 12 through which ink is delivered to multiple inkjet bodies. The body also includes an ink drop-forming orifice or nozzle 14. In general, the inkjet print head includes an array of closely spaced nozzles 14 that eject drops of ink onto an image receiving member (not shown), such as a sheet of paper or an intermediate member.

Ink flows from manifold 12 through a port 16, an inlet 18, a pressure chamber opening 20 into the body 22, which is sometimes called an ink pressure chamber. Ink pressure chamber 22 is bounded on one side by a flexible diaphragm 30. A piezoelectric transducer 32 is rigidly secured to diaphragm 30 by any suitable technique and overlays ink pressure chamber 22. Metal film layers 34, which can be electrically connected to an electronic transducer driver 36 in an electronic circuit, can be positioned on both sides of the piezoelectric transducer 32.

A firing signal is applied across metal film layers 34 to excite the piezoelectric transducer 32, which causes the transducer to bend. Actuating the piezoelectric transducers causes the diaphragm 30 to deform and force ink from the ink pressure chamber 22 through the outlet port 24, outlet channel 28, and nozzle 14. The expelled ink forms a drop of ink that lands onto an image receiving member. Refill of ink pressure chamber 22 following the ejection of an ink drop is augmented by reverse bending of piezoelectric transducer 32 and the concomitant movement of diaphragm 30 that draws ink from manifold 12 into pressure chamber 22.

To facilitate manufacture of an inkjet array print head, inkjet 10 can be formed of multiple laminated plates or sheets. These sheets are stacked in a superimposed relationship. Referring once again to FIGS. 5A and 5B, these sheets or plates include a diaphragm plate 40, an inkjet body plate 42, an inlet plate 46, an aperture brace plate 54, and an aperture plate 56. The piezoelectric-transducer 32 is bonded to diaphragm 30, which is a region of the diaphragm plate 40 that overlies ink pressure chamber 22.

One goal in the design of print heads and, in particular, inkjets incorporated into a print head, is increased printing speed. As is well known, print speed depends primarily on the packing density of the jets in the print head (jets per unit area), drop mass, and the jet operating frequency (rate that each jet can eject drops of ink). Individual jet design plays a major role in determining the maximum packing density, the drop mass, and the maximum operating frequency. For example, increasing inkjet packing density typically requires decreasing the size of inkjet structures such as piezoelectric transducers, diaphragms, and ink chambers without decreasing the size of drops that they are capable of generating.

Increasing the operating frequency of previously known inkjets may also decrease jet efficiency. To obtain a stable frequency response, the mechanical and fluidic resonant frequencies of the inkjets must be significantly higher than the jetting frequency with very little low frequency harmonic response. A single inkjet frequency response may be described as an analogue to the Helmholtz resonant frequency for wind musical instruments. In previously known inkjets, this frequency reaches a limit at about 46 kHz. This frequency is primarily dictated by the volume of liquid in the jet structure and the ratio of the inlet area to the inlet length. The stiffness of the actuator, which is comprised of the piezoelectric transducer and the diaphragm may also limit the operation frequencies. Reaching frequencies significantly above this limit is a desirable goal in inkjets.

SUMMARY

An inkjet ejector has been developed that enables the inkjet ejector to be operated at frequencies greater than 80 kHz. The inkjet ejector includes a body layer in which a pressure chamber is configured with a predetermined volume, a flexible diaphragm plate disposed on the pressure chamber to form a wall of the pressure chamber, a piezoelectric transducer having a bottom surface attached to the diaphragm plate, and an inlet layer in which an inlet channel is configured to connect the pressure chamber to a source of liquid ink, a cross-sectional area of the inlet channel at the pressure chamber divided by a length of the inlet channel being greater than a predetermined threshold.

Yet another embodiment of an inkjet ejector enables an inkjet ejector to be operated at a frequency greater than 80 kHz. The inkjet ejector includes a body layer in which a pressure chamber is configured with a predetermined volume, a flexible diaphragm plate disposed on the pressure chamber to form a wall of the pressure chamber, the diaphragm plate having a thickness that is greater than 10 μm, a piezoelectric transducer having a bottom surface attached to the diaphragm plate, the piezoelectric transducer having a thickness that is greater than 0.025 mm, and an inlet layer in which an inlet channel is configured to connect the pressure chamber to a source of liquid ink, a cross-sectional area of the inlet channel at the pressure chamber divided by a length of the inlet channel being greater than a predetermined threshold.

BRIEF DESCRIPTION OF THE DRAWINGS

The foregoing aspects and other features of the present disclosure are explained in the following description, taken in connection with the accompanying drawings, wherein.

DETAILED DESCRIPTION

Figure 1:
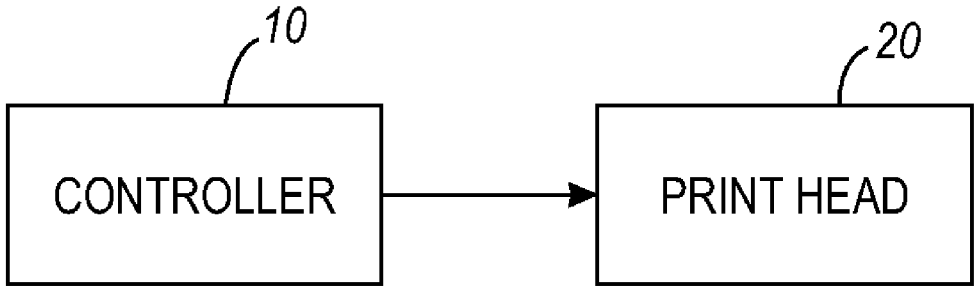
FIG. 1 is a block diagram of an embodiment of a drop-on-demand printing apparatus.

For a general understanding of the present embodiments, reference is made to the drawings. In the drawings, like reference numerals have been used throughout to designate like elements. As used herein, the term "imaging device" generally refers to a device for applying an image to print media. "Print media" can be a physical sheet of paper, plastic, or other suitable physical print media substrate for images. The print media may be supplied in either sheet form or as a continuously moving web. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

Also, as used herein, the word "printer" encompasses any apparatus that performs a print outputting function for any purpose, such as a digital copier, bookmaking machine, facsimile machine, a multi-function machine, etc. Devices of this type can also be used in bioassays, masking for lithography, printing electronic components such as printed organic electronics, and for making 3D models among other applications. The word "polymer" encompasses any one of a broad range of carbon-based compounds formed from long-chain molecules including thermoset polyimides, thermoplastics, resins, polycarbonates, and related compounds known to the art. The word "ink" can refer to wax-based inks known in the art but can refer also to any fluid that can be driven from the jets including water-based solutions, solvents and solvent based solutions, and UV curable polymers. The word "metal" may encompass either single metallic elements including, but not limited to, copper, aluminum, or titanium, or metallic alloys including, but not limited to, stainless steel or aluminum-manganese alloys. A "transducer" as used herein is a component that reacts to an electrical signal by generating a moving force that acts on an adjacent surface or substance. The moving force may push against or retract the adjacent surface or substance.

FIG. 1 is a block diagram of an embodiment of a drop-on-demand printing apparatus that includes a controller 10 and a print head assembly 20 that operates a plurality of high frequency inkjets. The controller 10 selectively energizes the inkjets in the print head assembly by providing a firing signal to each inkjet. Each inkjet may use a piezoelectric transducer that bends to generate a force to expel ink from an inkjet. As other examples, the inkjets may employ a shear-mode transducer, an annular constrictive transducer, an electrostrictive transducer, an electromagnetic transducer, or a magnetorestrictive transducer to expel ink. The ink utilized in the print head assembly 10 may be phase change ink which is initially in solid form and is then changed to a molten state by the application of heat energy. The molten ink may be stored in a reservoir (not shown) that is integral with or separate from the print head assembly for delivery as needed to the jet stack. Other inks that may be ejected by the print head assembly 20 include aqueous inks, emulsified inks, and gel inks that may or may not be heated to decrease the viscosity of the ink for jetting.

The print head assembly 20 includes a jet stack that is formed of multiple laminated sheets or plates, such as stainless steel plates. Cavities etched into each plate align to form channels and passageways that define the inkjets for the print head. Larger cavities align to form larger passageways that run the length of the jet stack. These larger passageways are ink manifolds arranged to supply ink to the inkjets. The plates are stacked in face-to-face registration with one another and then brazed or otherwise adhered together to form a mechanically unitary and operational jet stack.

Figure 2:
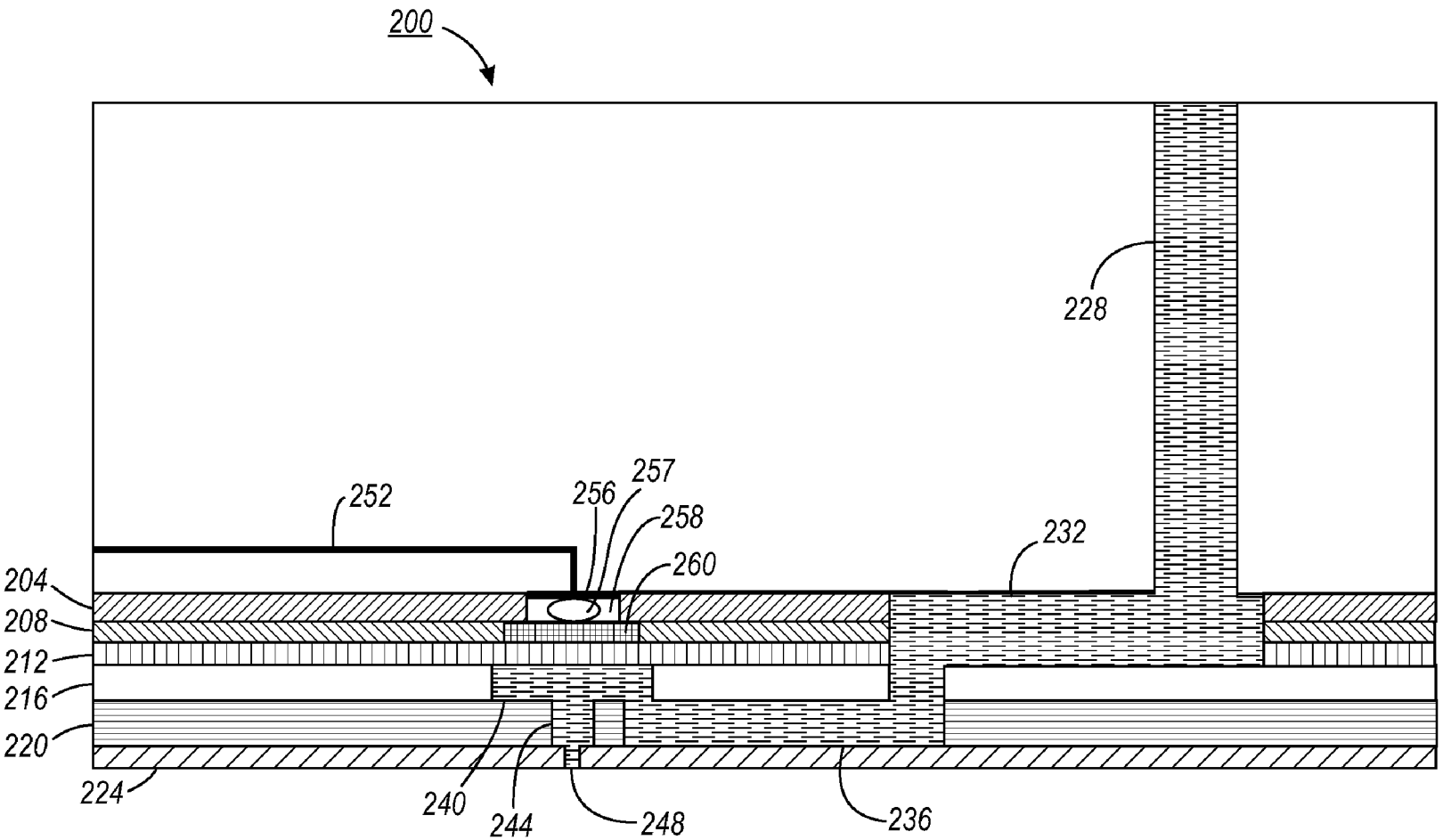
FIG. 2 is a cross sectional diagram depicting the internal configuration of an ink delivery system and a single ink jet that is capable of printing at a frequency greater than 80 kHz.

FIG. 2 is a cross sectional diagram of the internal components of an ink delivery system and inkjet stack that can print at a frequency of greater than 80 kHz. The stack includes a standoff layer 204 that leaves an air gap 258 located immediately above a piezoelectric transducer 260, which bends when an electric current is transmitted down transducer driver 252 to metallic film 256. A flexible electrically conductive connector 257 connects the metallic film with the transducer, allowing electric current to flow to the piezoelectric transducer. The flexible connector may be an electrically conductive adhesive such as silver epoxy which maintains the electrical connection with the piezoelectric transducer when the piezoelectric transducer bends either towards or away from the metallic film. The piezoelectric transducer is surrounded by a spacer layer 208 that supports the vertical stack. In the embodiment of FIG. 2, the standoff layer and spacer layer are each between 25 μm and 50 μm in thickness, and the piezoelectric transducer is between 25 μm and 75 μm in thickness. The piezoelectric transducer is attached to a flexible diaphragm 212 located immediately beneath the piezoelectric transducer. The electric current driving the piezoelectric transducer either bends the transducer towards the diaphragm or bends the transducer away from the diaphragm towards the air gap. The diaphragm responds to the bending of the piezoelectric transducer, and returns to its original shape once the electric signal to the piezoelectric transducer ceases. The diaphragm in the present embodiment may be selected to be in the range of 10-40 μm in thickness. Below the diaphragm is the body layer 216 in which lateral walls are configured to form a pressure chamber 240. The diaphragm is positioned immediately above the pressure chamber, forming one of its walls. In this embodiment, the body layer and pressure chamber are either 38 μm or 50 μm thick. The pressure chamber has four lateral walls that may optionally be approximately the same length forming a rhombus or square shaped area. In this embodiment each wall may range from 500 μm to 800 μm in length, defining the length and width dimensions of the inkjet stack. Below the body layer, the aperture brace layer 220 forms lateral walls around the outlet 244, which is fluidly connected to the pressure chamber. In this embodiment, the aperture brace layer and outlet are 50 μm thick. The combined volumes of the pressure chamber and the outlet should not exceed 0.025 $mm^3$. At the base, the aperture plate 224 surrounds the narrower ink aperture 248. The aperture is fluidly connected to the outlet. The aperture plate is 25 μm thick in the depicted embodiment. While FIG. 2 depicts an inkjet stack in an orientation with the aperture at the bottom of the figure, this is only one of many possible orientations including having the inkjet stack oriented in the opposite direction vertically, oriented horizontally, or at an arbitrary angle.

Continuing to refer to FIG. 2, ink travels from the port 228 to the manifold 232. The inkjet stack is fluidly connected to the manifold by an inlet channel 236, which is formed in an inlet layer, to enable ink to flow into the pressure chamber through the inlet channel. The inlet channel connects the manifold and the ejector of the inkjet stack to enable ink to flow from the manifold and enter the pressure chamber. In the embodiment shown in FIG. 2, the inlet channel length should not exceed 1.5 mm, in another embodiment, the length does not exceed 2 mm, and, in yet another embodiment, the length does not exceed 0.15 mm. Additionally, in the embodiment having an inlet channel length of 0.15 mm, the area of the inlet opening to the pressure chamber is at least 0.01 $mm^2$, but could be greater than 0.01 $mm^2$. The lengths of the inlet channel are determined with reference to a ratio of the cross-sectional area A of the inlet channel at the pressure chamber to the length L of the inlet channel. For a pressure chamber and outlet having a combined volume that does not exceed a volumetric threshold of 0.025 $mm^3$, the ratio of A/L must be greater than a predetermined linear threshold of 0.007 mm. For a pressure chamber and outlet having a combined volume that does not exceed a volumetric threshold of 0.01 $mm^3$, the ratio of A/L must be greater than a predetermined linear threshold of 0.05 mm. These dimensional constraints enable an inkjet ejector to operate at a frequency greater than 80 kHz. When the piezoelectric transducer bends in response to an electric current, the diaphragm deflects, urging the ink out of the pressure chamber into the outlet and aperture. The ink flows from the broader pressure chamber outlet to the narrower aperture where an ink droplet forms and is expelled from the inkjet stack. The piezoelectric transducer may then bend in the opposite direction, pulling the diaphragm away from the pressure chamber to pull ink from the inlet channel into the pressure chamber after a droplet is ejected.

Figure 3:
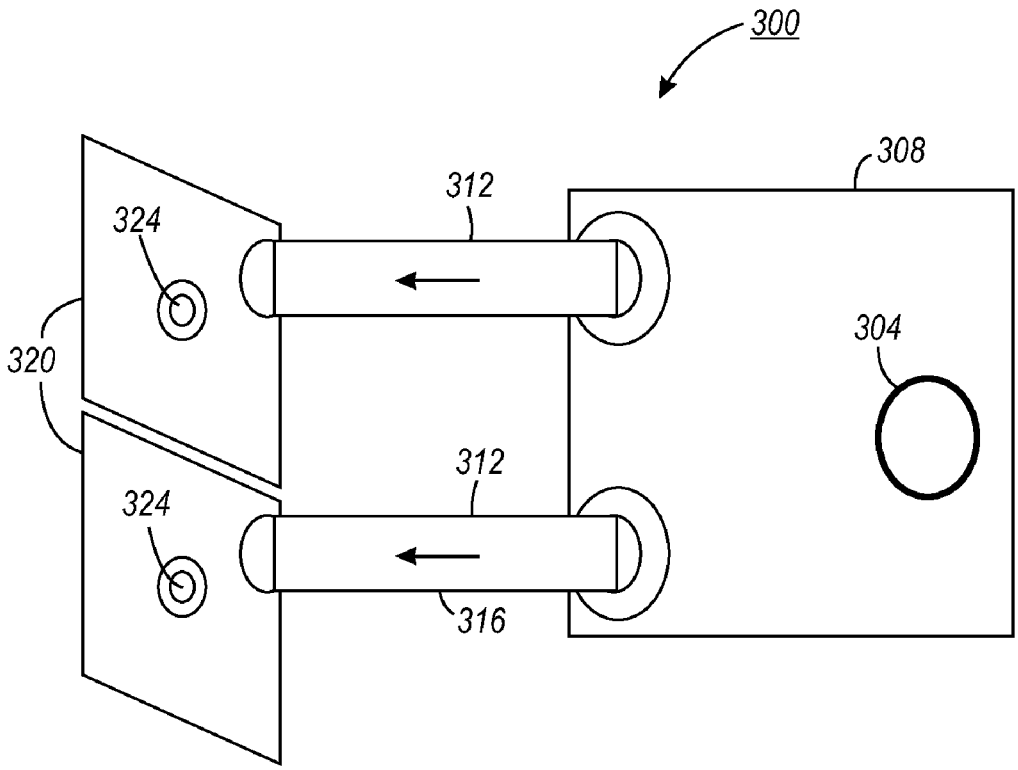
FIG. 3 is a diagram showing the external components of the ink jet stack of FIG. 2.

FIG. 3 depicts an exterior view 300 of the ink delivery system and two of the inkjet stacks as illustrated in FIG. 2. The port 304 and manifold 308 cavities that transfer ink to each inkjet are fluidly connected to each inkjet ejector by the inlet channel 312. Ink flows into the manifold through the port, and then in direction 316 from the manifold to the inkjet ejectors via the inlet channel. The embodiment presented in FIG. 3 depicts two adjacent inkjets 320, each connected to a common manifold channel, but many embodiments would connect more than two inkjets to the manifold chamber as shown in FIG. 3. Each inkjet ejector ejects the ink received from the inlet channel through an aperture in response to piezoelectric transducer 324 receiving a firing signal. In the present embodiment, the inlet channel should not exceed 1.5 mm in length with a cross-sectional area of 0.01 $mm^2$. In one embodiment, the inlet channel length is less than 0.2 mm and a cross-sectional area of 0.01 $mm^2$. The inlet channel connects the manifold to each inkjet in a way that forces the ink to flow around a corner at each end.

Figure 4:
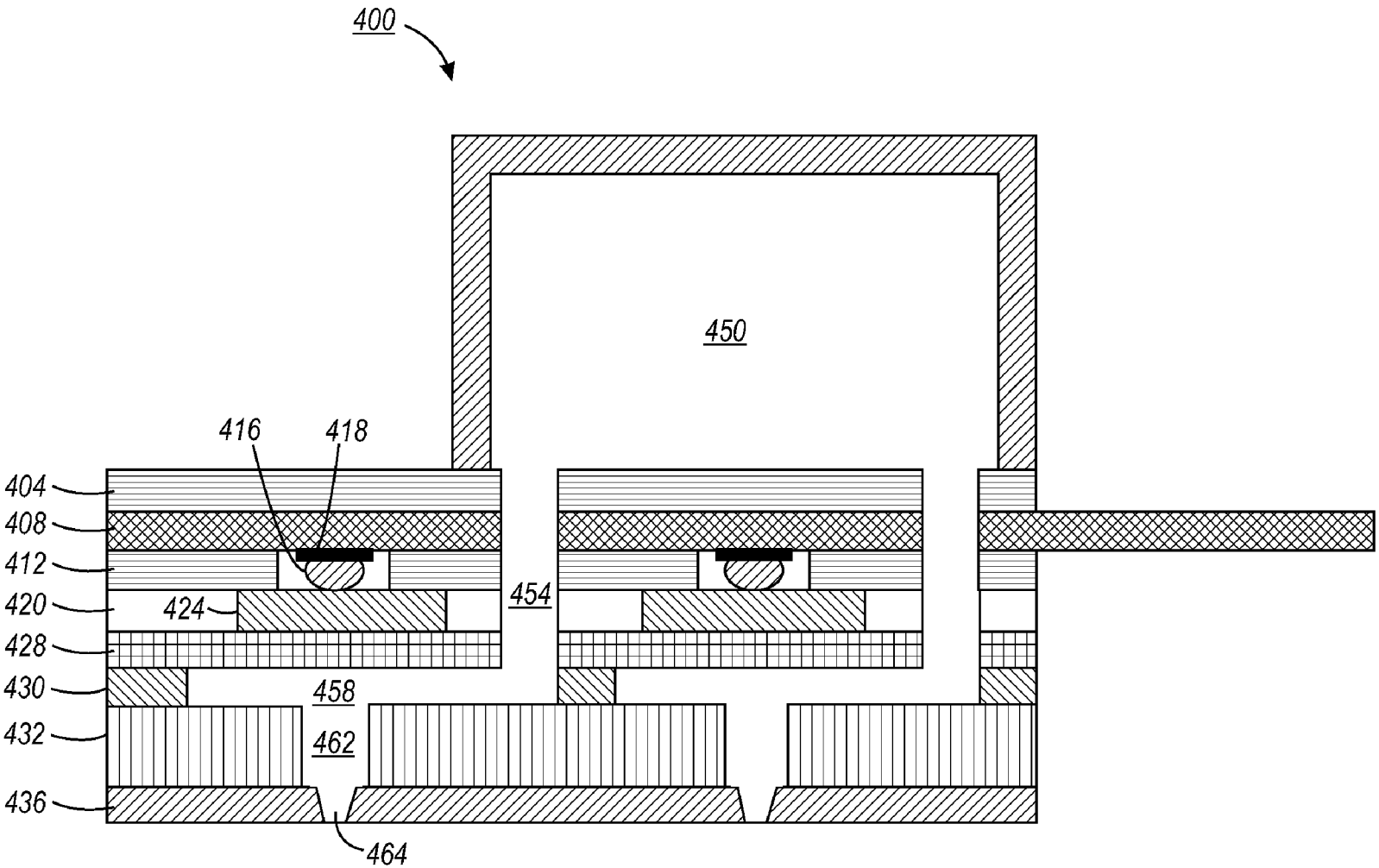
FIG. 4 is an alternative profile view depicting a print head capable of printing at a frequency greater than 80 kHz.
Figure 5A:
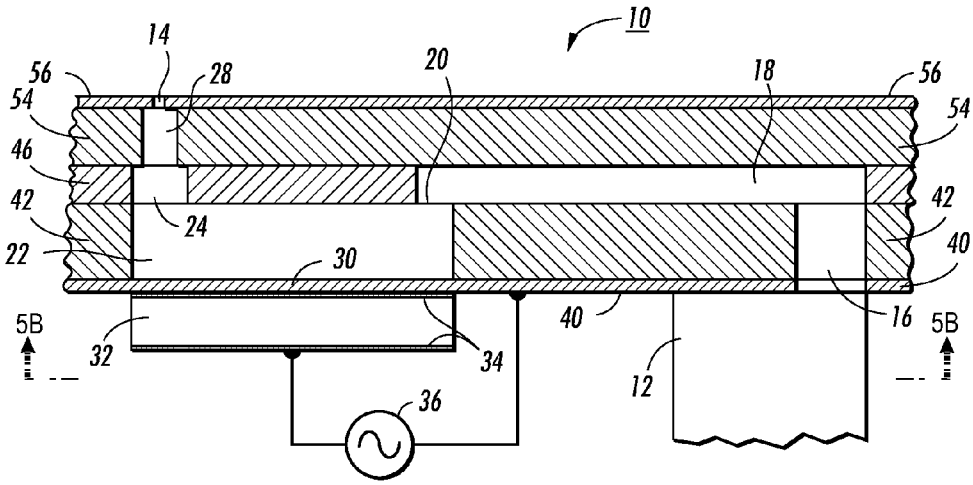
FIG. 5A PRIOR ART
FIG. 5A is a schematic side-cross-sectional view of a prior art embodiment of an inkjet.
Figure 5B:
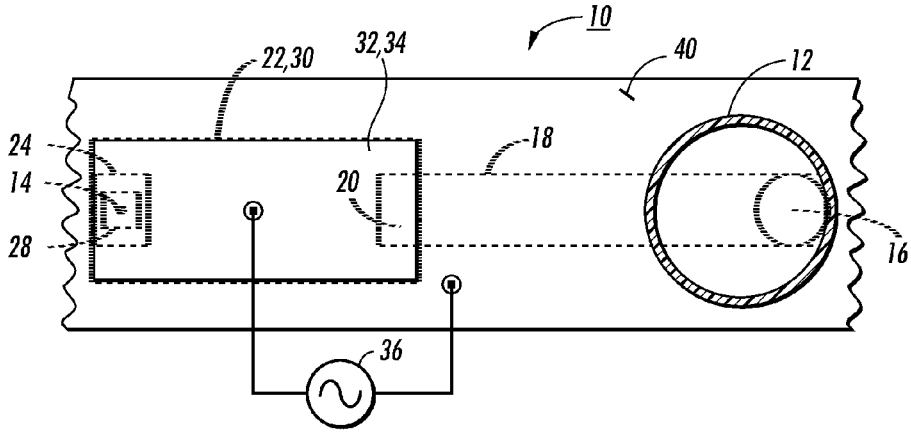
FIG. 5B PRIOR ART
FIG. 5B is a schematic view of the prior art embodiment of the inkjet of FIG. 5A.

FIG. 4 is an alternative profile view depicting a print head 400 capable of printing at a frequency greater than 80 kHz. An ink manifold 450 is mounted to electrical circuit board or flexible circuit 408 and is held in place by an adhesive layer 404. The jet stack is located on the opposite side of the flexible circuit held in place by the adhesive layer 412. The electrical path for the firing signals passes through the thin metal film 418, a conductive adhesive, such as silver epoxy 416, to the piezoelectric transducer 424. The electrically conductive adhesive 416 is placed in a gap surrounded by the adhesive layer 412. A polymer spacer layer 420 fills the spaces between the piezoelectric transducers 424. In the embodiment of FIG. 4, the adhesive layer 412 and the spacer layer 420 are each between 10 μm and 75 μm in thickness, and the piezoelectric transducer 424 is between 10 μm and 75 μm in thickness. The piezoelectric transducers are rigidly affixed to a metallic diaphragm layer 428. The diaphragm in the present embodiment may be selected to be in the range of 10-40 μm in thickness.

The diaphragm layer is attached to the body layer 430. The outlet layer 432 is attached to the body layer 430. The attachment of the two layers may be achieved by brazing multiple metal sheets together or forming the layers as a single plate, and in this embodiment, the body layer is 38 μm and the outlet layer is 50 μm thick. The body layer 430 and outlet layer 432 have multiple channels etched in them. The ink inlet channel 454 is formed from openings etched in the diaphragm layer 428 and body layer 430, with further openings made through flexible circuit 408, adhesive layer 412, and spacer layer 420. The ink inlet channel 454 places the manifold in fluid communication with the pressure chamber 458. The metal diaphragm layer 428 forms one wall of the pressure chamber 458, while the metal plates in the body layer 430 form lateral walls and the wall opposite the diaphragm is formed by the outlet layer 432. The pressure chamber has four lateral walls that may optionally be approximately the same length forming a rhombus or square shaped area. In this embodiment each wall may range from 500 μm to 800 μm in length, defining the length and width dimensions of the inkjet ejector stack. An ink outlet 462 etched into the outlet layer 432 is in fluid communication with the pressure chamber 458 and aperture 464. The outlet layer 432 is affixed to an aperture plate 436, which is 25 μm thick in the present embodiment. The aperture plate 436 contains apertures 464 which align with the ink outlets 462 and pressure chambers 458 to enable ink droplets to exit the print head. In the example embodiment of FIG. 4, the total volume of each pressure chamber 458, ink outlet 462, and aperture 464 should not exceed 0.025 $mm^3$.

In one embodiment of FIG. 4, the inlet channel length should not exceed 1.5 mm, in another embodiment, the length does not exceed 2 mm, and, in yet another embodiment, the length does not exceed 0.15 mm. Additionally, in the embodiment having an inlet channel length of 0.15 mm, the cross-sectional area of the inlet opening to the pressure chamber is at least 0.01 $mm^2$, but could be greater than 0.01 $mm^2$. The lengths of the inlet channel are determined with reference to a ratio of the cross-sectional area A of the inlet channel at the pressure chamber to the length L of the inlet channel. For a pressure chamber and outlet having a combined volume that does not exceed a volumetric threshold of 0.025 $mm^3$, the ratio of A/L must be greater than a predetermined linear threshold of 0.007 mm. For a pressure chamber and outlet having a combined volume that does not exceed a volumetric threshold of 0.01 $mm^3$, the ratio of A/L must be greater than a predetermined linear threshold of 0.05 mm. These dimensional constraints enable an inkjet ejector to operate at a frequency greater than 80 kHz.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An inkjet ejector comprising:

a body layer in which a pressure chamber is configured with an outlet having a volume that is less than a predetermined volumetric threshold;

a flexible diaphragm plate disposed on the pressure chamber to form a wall of the pressure chamber having a predetermined volume;

a piezoelectric transducer having a bottom surface attached to the diaphragm plate; and an inlet layer in which an inlet channel is configured to connect the pressure chamber to a source of liquid ink, a cross-sectional area of the inlet channel at the pressure chamber divided by a length of the inlet channel being greater than a predetermined linear threshold.

2. The inkjet ejector of claim 1 wherein the predetermined volumetric threshold is 0.025 $mm^3$ and the predetermined linear threshold is at least 0.007 mm.

3. The inkjet ejector of claim 1 wherein the predetermined volumetric threshold is 0.01 $mm^3$ and the predetermined linear threshold is at least 0.05 mm.

4. The inkjet ejector of claim 1 wherein the pressure chamber has a length that is greater than 390 μm and a width that is greater than 390 μm.

5. The inkjet ejector of claim 4 wherein the length and the width of the pressure chamber are approximately equal to form a rhombus lateral area for the pressure chamber.

6. The inkjet ejector of claim 1 wherein the pressure chamber has a length that is less than 810 μm and a width that is less than 810 μm.

7. The inkjet ejector of claim 6 wherein the length and the width of the pressure chamber are approximately equal to form a rhombus lateral area for the pressure chamber.

8. The inkjet ejector of claim 1 wherein the inlet channel is coupled between the pressure chamber and a manifold.

9. An inkjet stack comprising:

a body layer in which a pressure chamber is configured with an outlet having a volume that is less than a predetermined volumetric threshold;

a flexible diaphragm plate disposed on the pressure chamber to form a wall of the pressure chamber, the diaphragm plate having a thickness that is greater than 10 μm;

a piezoelectric transducer having a bottom surface attached to the diaphragm plate, the piezoelectric transducer having a thickness that is greater than 0.025 mm; and an inlet layer in which an inlet channel is configured to connect the pressure chamber to a source of liquid ink, a cross-sectional area of the inlet channel at the pressure chamber divided by a length of the inlet channel being greater than a predetermined linear threshold.

10. The inkjet ejector of claim 9 wherein the predetermined volumetric threshold is 0.025 $mm^3$ and the predetermined linear threshold is at least 0.007 mm.

11. The inkjet ejector of claim 9 wherein the predetermined volumetric threshold is 0.01 $mm^3$ and the predetermined linear threshold is at least 0.05 mm.

12. The inkjet ejector of claim 9 wherein the pressure chamber has a length that is greater than 390 μm and a width that is greater than 390 μm.

13. The inkjet ejector of claim 12 wherein the length and the width of the pressure chamber are approximately equal to form a rhombus lateral area for the pressure chamber.

14. The inkjet ejector of claim 9 wherein the pressure chamber has a length that is less than 810 μm and a width that is less than 810 μm.

15. The inkjet ejector of claim 14 wherein the length and the width of the pressure chamber are approximately equal to form a rhombus lateral area for the pressure chamber.

16. The inkjet ejector of claim 9 wherein the inlet channel is coupled between the pressure chamber and a manifold.

* * * * *